US008881866B1

(12) United States Patent
Costello

(10) Patent No.: US 8,881,866 B1
(45) Date of Patent: Nov. 11, 2014

(54) SELF-RESCUE DEVICE

(71) Applicant: Diana Costello, Jersey City, NJ (US)

(72) Inventor: Diana Costello, Jersey City, NJ (US)

( * ) Notice: Subject to any disclaimer, the term of this patent is extended or adjusted under 35 U.S.C. 154(b) by 0 days.

(21) Appl. No.: 14/225,110

(22) Filed: Mar. 25, 2014

Related U.S. Application Data

(60) Provisional application No. 61/852,872, filed on Mar. 25, 2013, provisional application No. 61/855,911, filed on May 28, 2013, provisional application No. 61/855,912, filed on May 28, 2013.

(51) Int. Cl.
*E06C 9/12* (2006.01)

(52) U.S. Cl.
CPC ..... *E06C 9/12* (2013.01)
USPC ..... 182/97; 182/18; 182/39; 182/49; 182/129; 182/82

(58) Field of Classification Search
USPC ..... 182/86, 97, 93, 85, 82, 49, 36, 39, 98, 182/1, 2.5, 8, 12, 13, 15, 18, 21, 48, 63.1, 182/64.1, 76, 77, 78, 94, 107, 112, 115, 182/116, 129, 156, 180.2, 194, 230, 33, 89, 182/88, 83, 84, 91
See application file for complete search history.

(56) References Cited

U.S. PATENT DOCUMENTS 259,846 A * 6/1882 Garton ..... 182/1
508,099 A * 11/1893 Fisher ..... 182/39
521,381 A * 6/1894 Mallory ..... 182/13
938,016 A * 10/1909 Niblack ..... 182/15
1,152,961 A * 9/1915 Morand ..... 182/70
1,205,684 A * 11/1916 Tothill ..... 182/97
1,658,192 A * 2/1928 Hampton ..... 188/42
1,953,038 A * 3/1934 Bessler ..... 182/81
1,982,865 A * 12/1934 Gross ..... 182/85
2,084,303 A * 6/1937 Applegarth ..... 182/85
2,382,370 A * 8/1945 Tully et al. ..... 105/326
2,522,336 A * 9/1950 Anderson ..... 182/1
2,622,783 A * 12/1952 Mahoney ..... 182/89
2,886,228 A * 5/1959 Susikari ..... 182/97
3,068,958 A * 12/1962 McCann ..... 182/89
3,083,784 A * 4/1963 Urian ..... 182/88
3,136,386 A * 6/1964 Jung et al. ..... 182/77
3,351,220 A * 11/1967 Kirkbride ..... 414/541
3,363,722 A * 1/1968 Rimi ..... 182/89
3,403,749 A * 10/1968 Warren ..... 182/88
3,556,248 A * 1/1971 Brown et al. ..... 182/15
3,729,062 A * 4/1973 Freiburger ..... 182/39
3,903,991 A * 9/1975 Phelan ..... 182/93
4,029,223 A * 6/1977 Adamski et al. ..... 414/546
4,290,502 A * 9/1981 Anderson ..... 182/33
4,311,208 A * 1/1982 Macrorie et al. ..... 182/18
4,971,168 A * 11/1990 Stanescu ..... 182/1
5,005,667 A * 4/1991 Anderson ..... 182/15
5,044,465 A * 9/1991 Rinke ..... 182/97
5,148,889 A * 9/1992 Fenwick et al. ..... 182/17
5,152,244 A * 10/1992 Jarmillo et al. ..... 114/362
5,163,531 A * 11/1992 Whiting ..... 182/89
5,366,052 A * 11/1994 Keh-Lin ..... 182/88

(Continued)

*Primary Examiner* — Daniel Cahn
(74) *Attorney, Agent, or Firm* — Fish & Richardson P.C.

(57) ABSTRACT

A self-rescue device that features an escape ladder, having one or more spaced steps, a base to hold the escape ladder in an open or closed position, a locking mechanism to keep the escape ladder in the open position, and a release mechanism to release the escape ladder from the open position.

7 Claims, 8 Drawing Sheets

(56) References Cited

U.S. PATENT DOCUMENTS

| | | | | |
|---|---|---|---|---|
| 5,794,292 | A * | 8/1998 | Ricci, Jr. | 14/69.5 |
| 5,950,267 | A * | 9/1999 | Ricci, Jr. | 14/71.1 |
| 6,581,876 | B2 * | 6/2003 | Cheung | 244/118.5 |
| 6,659,224 | B2 * | 12/2003 | Medsker | 182/91 |
| 7,828,117 | B2 * | 11/2010 | Cole | 182/33 |
| 2004/0026168 | A1 * | 2/2004 | Buchanan et al. | 182/96 |
| 2004/0251080 | A1 * | 12/2004 | Kalos | 182/35 |
| 2009/0211842 | A1 * | 8/2009 | Baker et al. | 182/12 |
| 2012/0273303 | A1 * | 11/2012 | Perkins | 182/129 |
| 2013/0068557 | A1 * | 3/2013 | Rasmussen | 182/36 |
| 2014/0097039 | A1 * | 4/2014 | Kerr | 182/39 |

* cited by examiner

SELF-RESCUE DEVICE

CROSS REFERENCE TO RELATED APPLICATIONS

This application claims the benefit of the filing dates of U.S. Provisional Application Nos. 61/852,872, 61/855,911 and 61/855,912, which were filed on Mar. 25, 2013, May 28, 2013 and May 28, 2013, respectively. The contents of U.S. Provisional Application Nos. 61/852,872, 61/855,911 and 61/855,912 are incorporated herein by reference in their entirety.

FIELD OF INVENTION

This application relates to a self-rescue device.

BACKGROUND

Subway and train platforms can be dangerous places. There is often not an easy way for a person who has fallen off the platform or is on the train tracks to climb back onto the platform.

SUMMARY

One aspect features an escape ladder with a number of spaced steps. A base holds the escape ladder in a closed position or an open position. A locking mechanism keeps the escape ladder in the open position and a release mechanism releases the escape ladder from the open position. Another aspect features the escape ladder, base, locking mechanism, and release mechanism along with a self-retracting mechanism that closes the escape ladder from the open position to the closed position.

DETAILED DESCRIPTION

Figure 1:
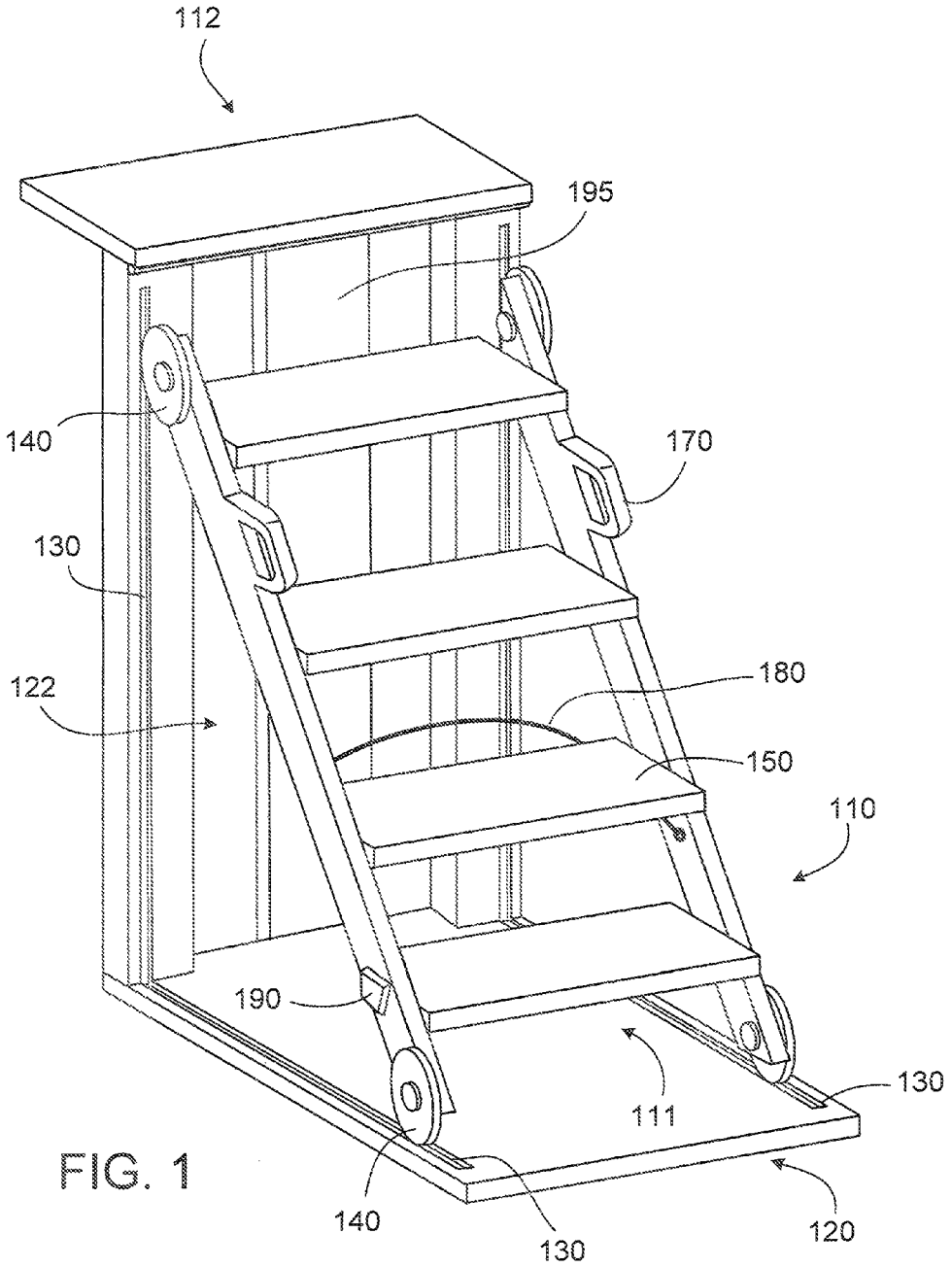
FIG. 1 is a front view of an escape ladder in the open position.
Figure 2:
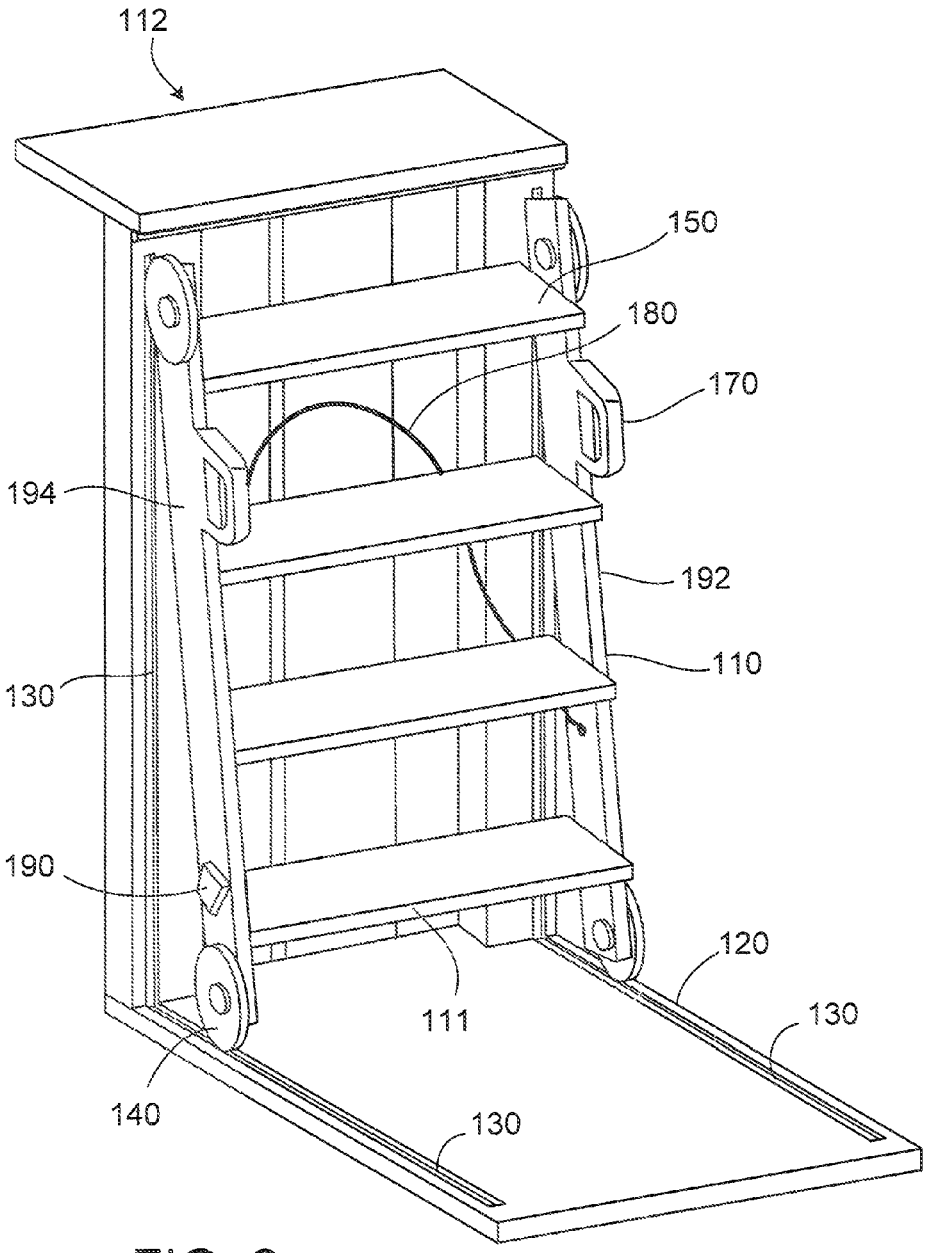
FIG. 2 is a front view of an escape ladder in the closed position.

Referring to the Figures, a self-rescue device includes an escape ladder 110, and a base 120. One implementation is shown in FIG. 1-4 and another implementation is show in FIG. 5-7. The escape ladder 110 extends from a closed position, shown in FIG. 2, to an open position, shown in FIG. 1, so that a user can climb the escape ladder 110 and reach the terminal end 112 of the escape ladder 110. A locking mechanism 370, shown in FIG. 3, maintains the escape ladder in the open position while it is use. A release mechanism 360 may be used to disengage the escape ladder 110 from its open position and, when included, a self-retracting mechanism 310, returns the escape ladder 110 to the closed position after use.

The escape ladder 110 may be opened by the user by pulling handles 170 toward himself or herself. The escape ladder 110 has a plurality of steps 150 beginning at a starting, or lower, end 111 and ending at a terminal, or upper, end 112 at opposite ends of a longitudinal axis of the escape ladder 110. The escape ladder 110 may have wheels or skids 140 on its starting end 111 and terminal end 112 to assist in moving the ladder to and from the open position. The wheels or skids 140 may move along guide channels 130 on the base 120 as the escape ladder 110 moves. The base 120 has a bottom horizontal portion and a vertical upright back portion 121. The base 120 can be secured in a stationary position, such as by having its bottom portion be affixed to the surface on which it rests, or by having its back portion 121 be affixed to a surface behind it. The base 120 may also be movable from one position to another position when the escape ladder is to be used. The locking mechanism 370 is engaged when the escape ladder 110 is in the open position and holds the escape ladder in the open position until locking mechanism 370 is disengaged by the operation of the release mechanism 360. The release mechanism 360 can be coupled to the back portion 121 of the base 120 or to the escape ladder 110. The release mechanism 360 includes a flange 350, an actuator 320, and a clasp 330. In one implementation, the locking mechanism 370 holds the escape ladder 110 in position through a mechanical force. The release mechanism 360 interacts with the locking mechanism 370 either directly or through actuators. The locking mechanism 370 and release mechanism 360 may be assembled as one unit. The release mechanism 360 may be integrated with the escape ladder 110 or the base 120, or may be positioned independently from the escape ladder 110 or the base 120. The self-retracting mechanism 310, when included, stores compressive force as the escape ladder 110 moves from a closed position to an open position. The self-retracting mechanism 310 can comprise elastic materials that store mechanical energy, including, but not limited to, extension springs, compression springs, and torsion springs. The device can have an alarm 190 that emits a signal, such as light or sound, when the escape ladder 110 is not in the closed position. The alarm 190 may be placed anywhere on the device, as long as its signal can be detected by observers.

Figure 8:
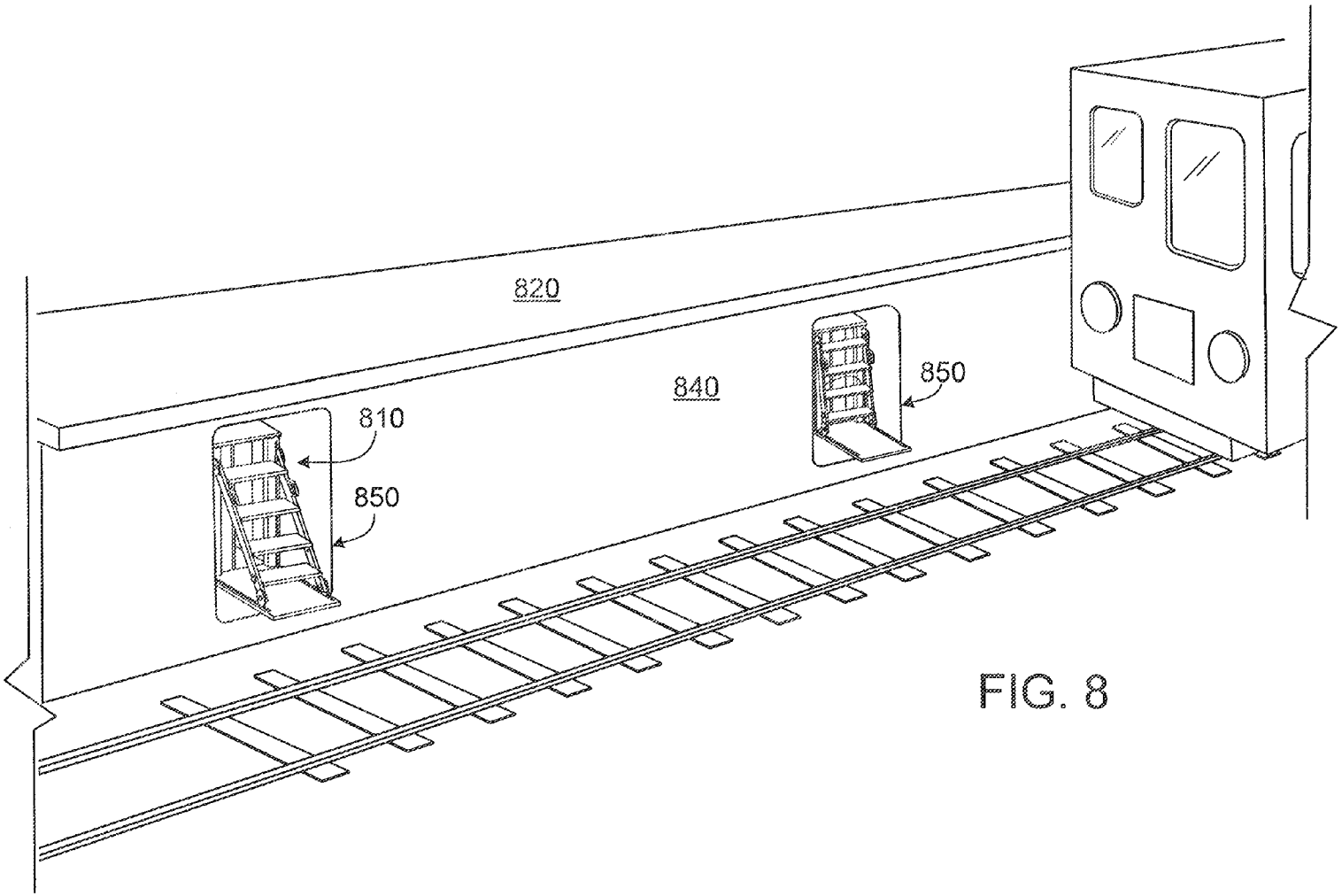
FIG. 8 illustrates the device in position in a train station.

Referring to FIG. 8, the self-rescue device 810 may be placed underneath a subway or train platform 820, or other overhanging horizontal surface, in a recess 850 in the support structure 840 for the platform. The bottom horizontal portion of the base 120 can be at track level or above track level. When in its closed position, the escape ladder 110 fits inside the recess 850 without obstructing oncoming train traffic. In an emergency, a person on track level uses the self-rescue device 810 by extending the escape ladder 110 to its open position and safely climbing to the platform. In doing so, the user triggers the self-release mechanism 360, which disengages the escape ladder 110 from its open, locked position (as further described below) and a self-retracting mechanism 310, when included, returns the escape ladder 110 to the closed position, so that an approaching train will be free to pass through without being obstructed by the escape ladder 110. One or more additional self-rescue devices 810 can be placed in one or more additional recesses 850 at intervals along the subway or train platform 820. The self-rescue device can be constructed from wood, metal, plastic, composite, polymer, or any combinations thereof. The escape ladder 110, base 120, locking mechanism 370, release mechanism 360, and self-retracting mechanism 310 may be constructed as a single unit or assembled from multiple components. Each part of the device may be assembled by fastening, welding, or chemically bonding together multiple components. The exact size of the device and each of its components can vary according to need (the Figures are not drawn to scale).

Figure 3:
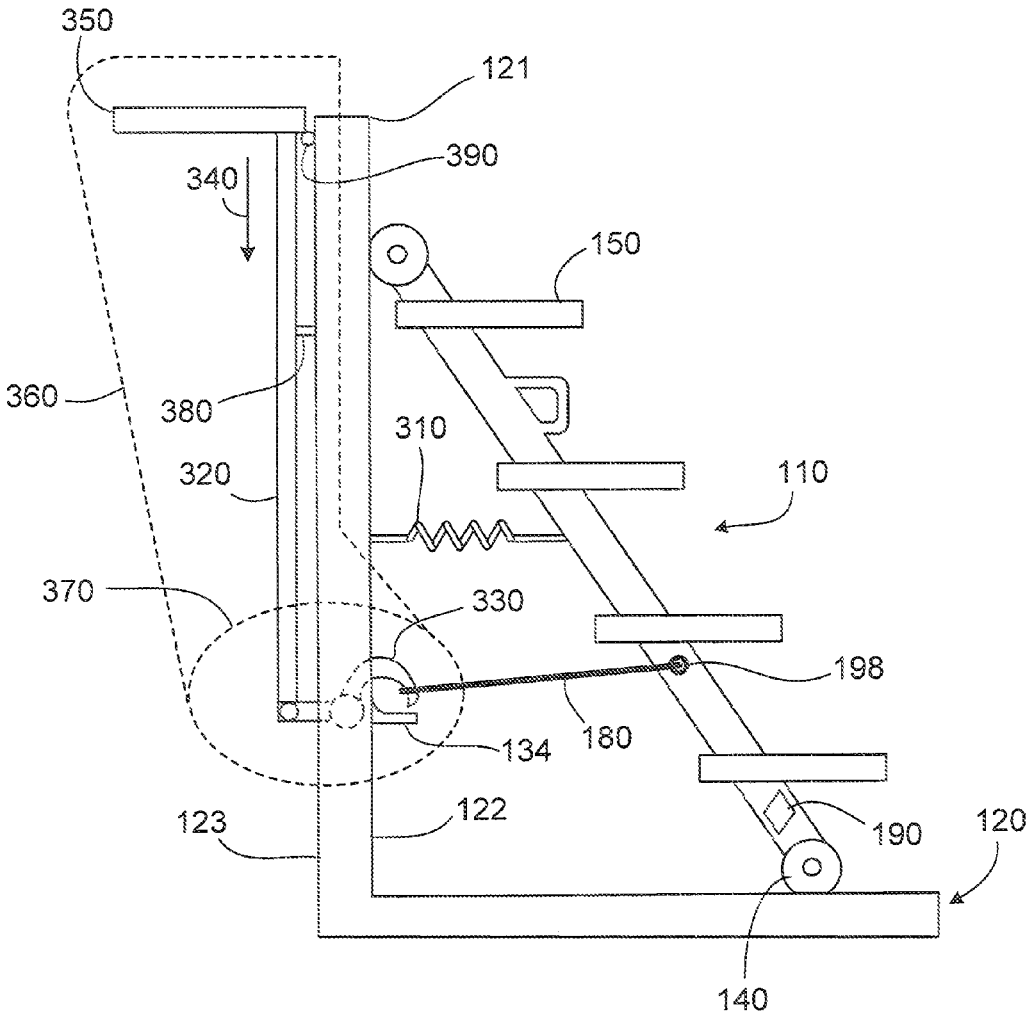
FIG. 3 is a side view of an implementation of the device, with the escape ladder in the open position.
Figure 4:
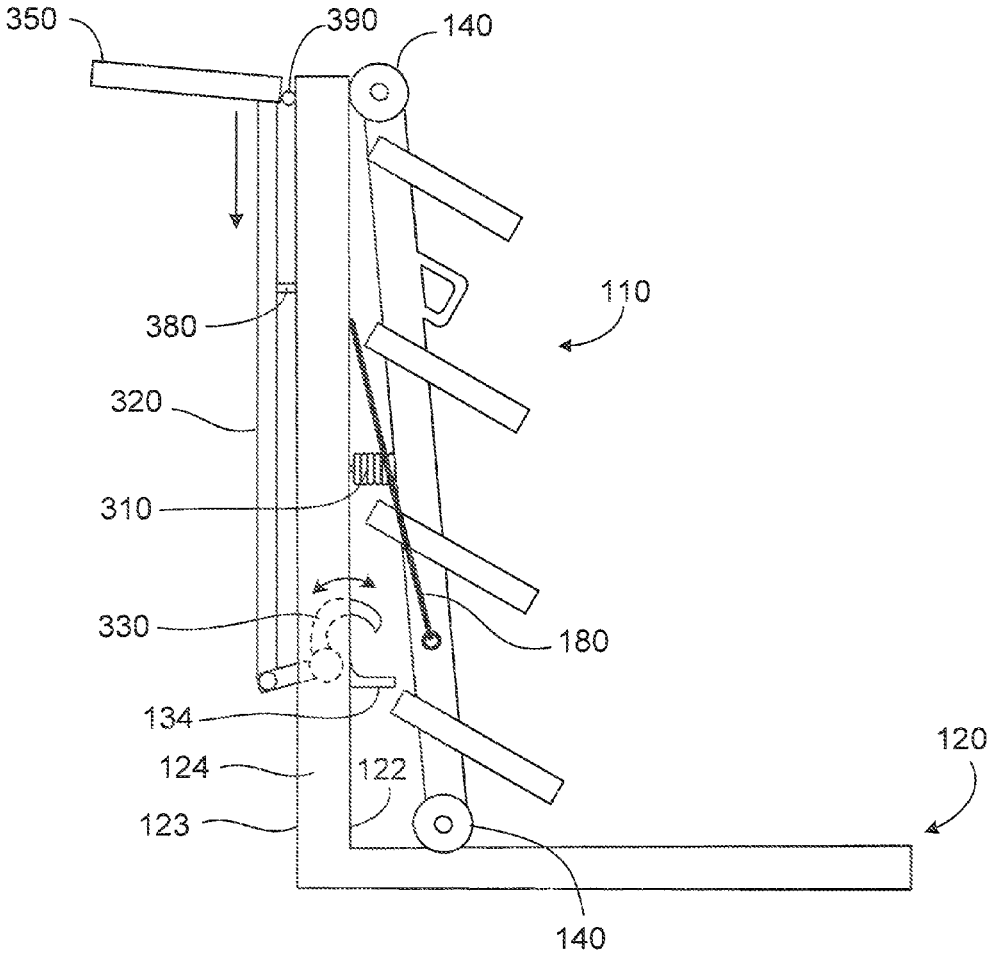
FIG. 4 is a side view of the implementation of FIG. 3, with the escape ladder in the closed position.

In one implementation, the escape ladder 110 can be opened manually by pulling two handles 170, one on the right edge 192 and the other on the left edge 194 of the escape ladder 110. The escape ladder 110 has wheels 140 placed at the starting end 111 and at the terminal end 112 of the escape ladder 110. The wheels 140 travel along guide channels 130 on the horizontal portion and the upright portion of base 120 as the escape ladder 110 travels between the closed position and the open position. Referring to FIGS. 1 and 3, a locking mechanism 370 comprises a locking guide 180 connected at one side to the right edge 192 and at the other side to the left edge 194 of the escape ladder 110 by pivots 198. When the escape ladder 110 is opened into the open position, locking guide 180 rotates down toward a clasp 330 and a rest 134, which engage the locking guide 180 and hold the escape ladder 110 in the open position. An alarm 190 on the base 120 emits a signal such as light or sound when the escape ladder 110 is not in the closed position. A release mechanism 360, having a flange 350 that is coupled by one or more hinges to the top of the upright portion or back of base 120, is connected to an actuator 320. The actuator 320 is, in turn, coupled to clasp 330. The clasp 330 can be held in a closed position by a spring (not shown). Referring now to FIG. 3, the flange 350 is connected to the upright portion of base 120 by a hinge 390 that allows the flange 350 to pivot and move the actuator in direction 340 as the user treads on it. The actuator 320 pivots the clasp 330 in an open position and releases the locking guide 180, thereby disengaging the escape ladder 110 from the locked open position. A self-retracting mechanism 310, comprising a spring tension system 310 connecting the escape ladder 110 and the base 120, closes the escape ladder 110 from the open position to the closed position. The spring tension system 310 may consist of multiple springs connected to the escape ladder 110 and base 120. Referring to FIG. 4, after the release mechanism 360 is engaged, the clasp 330 pivots back into the base and allows the locking guide 180 to travel up the base as the escape ladder 110 returns to the closed position. Referring to FIGS. 1 and 4, the friction between the locking guide 180 and front side 122 of the base 120 is minimized by choice of materials or the placement of one or more planks 195.

Figure 5:
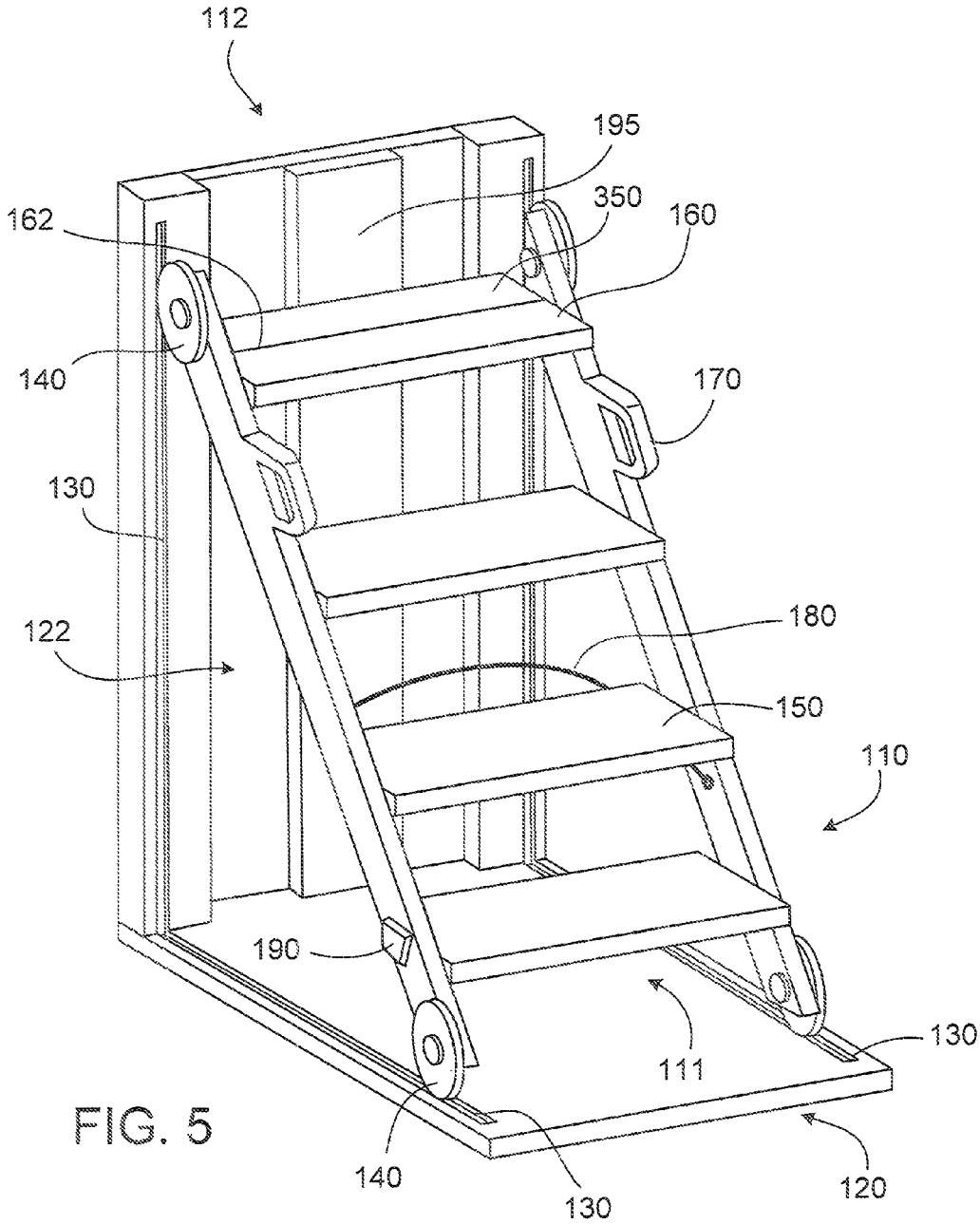
FIG. 5 is a front view of another implementation of the device, with the escape ladder in the open position.
Figure 6:
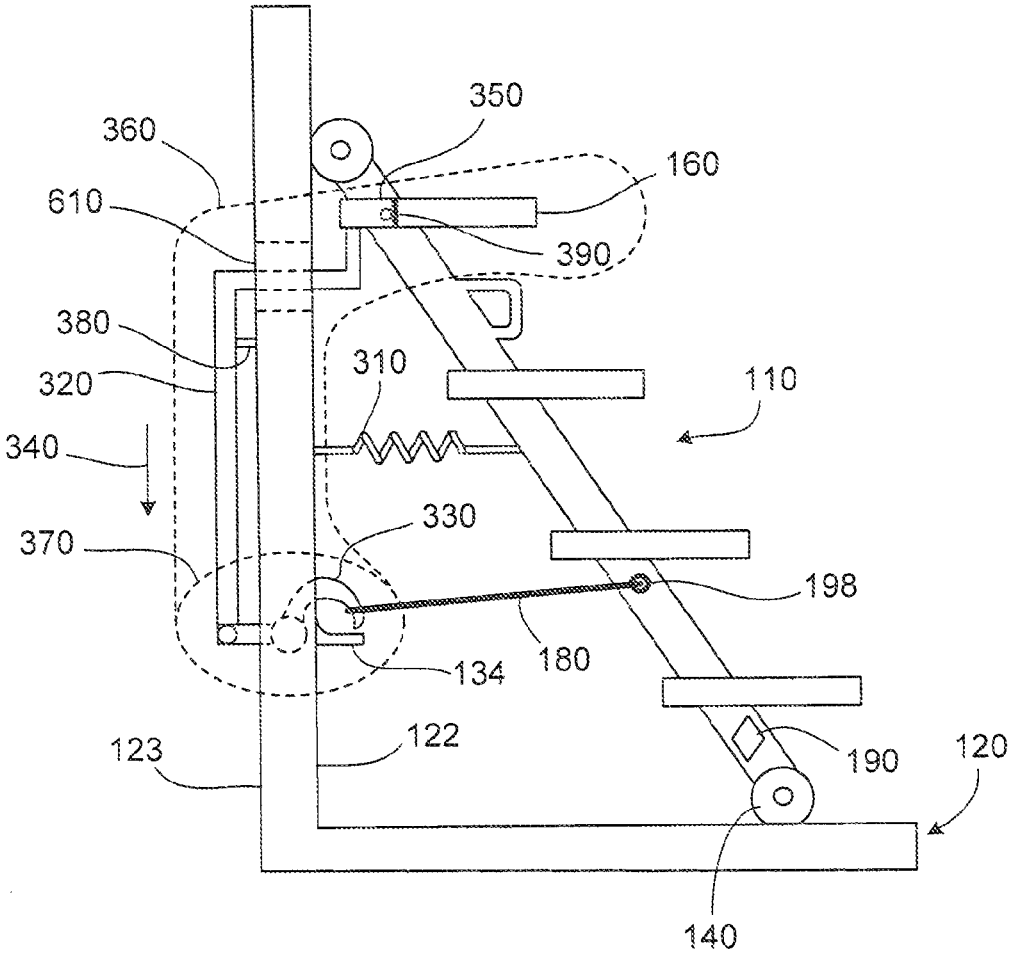
FIG. 6 is a side view of the implementation of FIG. 5, with the escape ladder in the open position.
Figure 7:
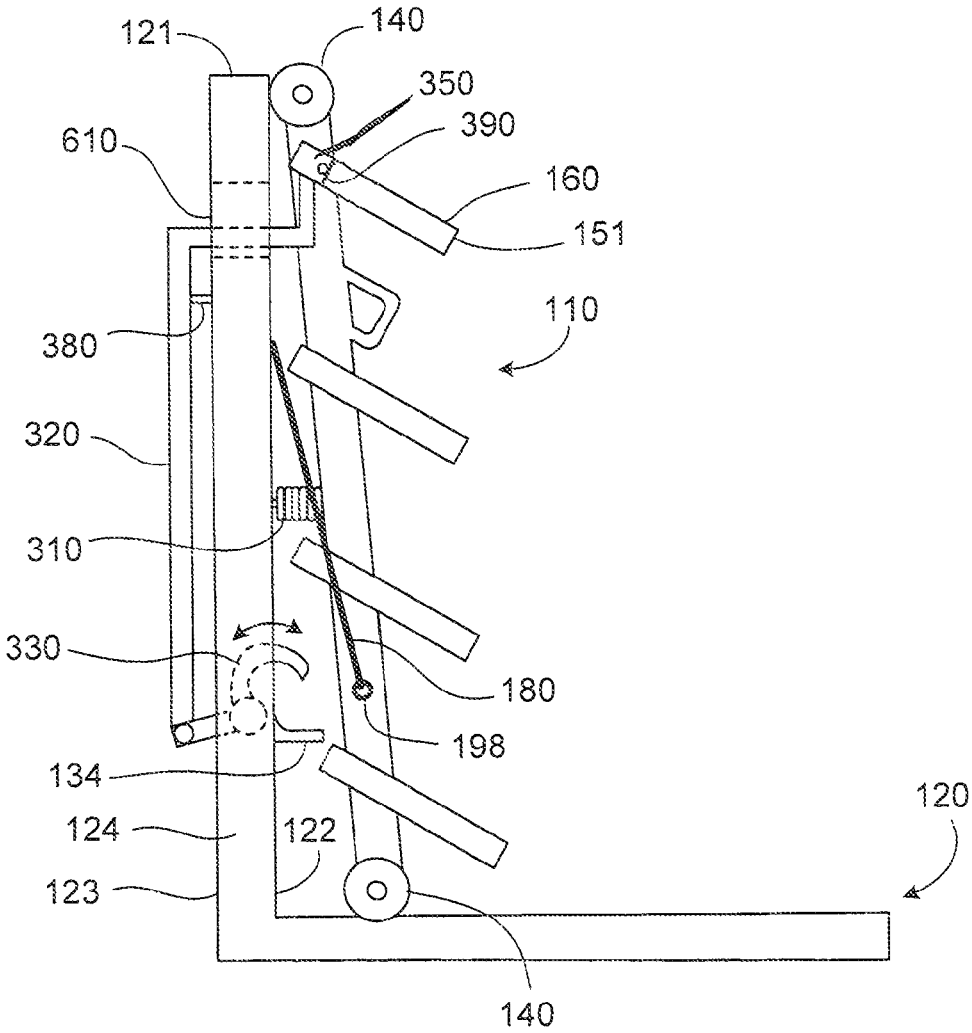
FIG. 7 is a side view of the implementation of FIG. 5, with the escape ladder in the closed position.

In another implementation, the release mechanism 360 is part of the escape ladder 110. Referring to FIG. 5-7, the release mechanism 360 has a flange 350 that is coupled by one or more hinges 390 along an edge 162 that separates the top step 160 of the escape ladder 110 from the flange 350. The flange 350 is pivotally connected to an actuator 320 on the front side 122 of the base 120. The actuator 320 continues through an opening 610 in the back portion 121 of the base 120 and is coupled to clasp 330 on the back side 123 of the base 120. The flange 350 pivots on the hinge 390 as the user treads on it and moves the actuator 320 in direction 340. The actuator 320 pivots the clasp 330 and releases the locking guide 180, thereby disengaging the escape ladder 110 from the locked open position. The opening 610 in the back portion 121 of the base is large enough to accommodate the upward and downward movement of the actuator 320.

In other implementations, the actuator 320 may be positioned on the front side 122 of the base 120, the back side 123 of the base 120, or inside 124 of the base 120. The actuator 320 may also be held in a stable position relative to the base by one or more stabilizers 380. The flange 350 can be connected to the back portion 121 of the base 120, the escape ladder 110, or another fixed position. Other implementations of the device do not have a self-retracting mechanism 310.

The self-escape device can be used in many places and in many situations. The device is helpful in subway or train stations, where each year a number of people may die after falling onto the train or subway tracks. Many of the victims are unable to safely climb back to the platform. The device serves as a quick and easy escape route for those who have fallen in front of an oncoming train. Video cameras can be placed along the train tracks or in train tunnels and can transmit images to monitors in approaching trains or to station masters. Train operators will be alerted to any emergencies and can slow down or stop until a fallen victim has climbed to safety.

Other embodiments are within the scope of the following claims.

What is claimed is:

1. A rescue device comprising:

an escape ladder movable between an open position and a closed position, the escape ladder having a starting end and a terminal end respectively positioned at opposite ends of a major longitudinal axis of the escape ladder, one or more steps positioned between stiles of the escape ladder and positioned between the starting end and the terminal end of the escape ladder, first wheels placed at the starting end and second wheels placed at the terminal end of the escape ladder, and a locking guide connected to the escape ladder;

a base having a major vertical surface substantially orthogonal to a major horizontal surface to support the escape ladder in the closed position or the open position, the base having a major length of at least one vertical channel in the major vertical surface substantially extending orthogonally to a major length of at least one horizontal channel in the major horizontal surface, the first wheels configured to travel in the at least one horizontal channel simultaneously as the second wheels travel in the at least one vertical channel when the escape ladder moves between the open and closed positions;

a retracting mechanism having a spring attached between the major vertical surface and the escape ladder, the spring configured to bias the escape ladder from the open position to the closed position;

a locking mechanism having a clasp configured to engage the locking guide which maintains the escape ladder in the open position; and a release mechanism having an actuator connected to the clasp, the release mechanism configured to open the clasp and release the locking guide from the clasp to directly cause the spring to move the escape ladder from the open position to the closed position;

wherein the major longitudinal axis is substantially parallel to the major vertical surface when the escape ladder is in the closed position, and the major longitudinal axis is positioned at an angle with respect to the major vertical surface and the major horizontal surface when the escape ladder is in the open position to allow a user to ascend the escape ladder.

2. The rescue device of claim 1, wherein the rescue device is constructed from wood, metal, plastic, composite, polymer, or any combinations thereof.

3. The rescue device of claim 1, wherein the release mechanism is coupled to a top of a back portion of the base.

4. The rescue device of claim 1, wherein the release mechanism includes a flange hingedly coupled to a top of the base.

5. The rescue device of claim 1, wherein the release mechanism includes a flange hingedly coupled to a step of said one or more steps of the escape ladder.

6. The rescue device of claim 1, wherein the base resides in a recess in a support structure for an overhanging horizontal surface.

7. The rescue device of claim 1, wherein the escape ladder includes an alarm that is capable of emitting a signal when the escape ladder is not in the closed position.

* * * * *